US009833918B1

(12) United States Patent
Clarke

(10) Patent No.: US 9,833,918 B1
(45) Date of Patent: Dec. 5, 2017

(54) APPARATUS FOR SPLITTING WOOD INTO KINDLING

(71) Applicant: Dana Stone Clarke, Bend, OR (US)

(72) Inventor: Dana Stone Clarke, Bend, OR (US)

( * ) Notice: Subject to any disclaimer, the term of this patent is extended or adjusted under 35 U.S.C. 154(b) by 0 days.

(21) Appl. No.: 14/992,881

(22) Filed: Jan. 11, 2016

Related U.S. Application Data

(60) Division of application No. 14/712,739, filed on May 14, 2015, now abandoned, which is a continuation-in-part of application No. 13/843,064, filed on Mar. 15, 2013, and a continuation-in-part of application No. 12/507,021, filed on Jul. 21, 2009, now Pat. No. 8,424,212.

(51) Int. Cl.
*B26B 23/00* (2006.01)
*B27L 7/00* (2006.01)
*B25D 1/00* (2006.01)

(52) U.S. Cl.
CPC ..... *B26B 23/00* (2013.01); *B25D 1/00* (2013.01); *B27L 7/005* (2013.01)

(58) Field of Classification Search
CPC ..... B26B 23/00; B25D 1/00; B27L 7/005
USPC ..... 30/308.1, 167–167.2, 171, 172, 164.5, 30/164.8, 142, 299, 302; 81/20; 403/230, 247, 248; D8/7, 10, 11, 47, D8/76–81; 7/145, 104, 114, 116, 122, 7/158, 159; 172/371, 374, 375, 377, 381, 172/382; 125/40–43
See application file for complete search history.

(56) References Cited

U.S. PATENT DOCUMENTS

| | | | | |
|---|---|---|---|---|
| 111,024 A * | 1/1871 | White | B26B 3/00 30/308.1 |
| 153,164 A | 7/1874 | Morrison | |
| 153,364 A | 7/1874 | Morrison | |
| 176,807 A * | 5/1876 | Potter | F16B 12/2009 30/308.1 |
| 263,104 A | 8/1882 | Bickel | |
| 292,184 A | 1/1884 | Thompson | |
| 292,644 A | 1/1884 | Fuchs | |
| 378,650 A * | 2/1888 | Bigelow | B25D 1/00 81/20 |

(Continued)

FOREIGN PATENT DOCUMENTS

| | | |
|---|---|---|
| AT | 185266 | 4/1956 |
| DE | 4035679 | 9/1990 |

(Continued)

*Primary Examiner* — Jason Daniel Prone
(74) *Attorney, Agent, or Firm* — Birdwell & Janke, LLP

(57) ABSTRACT

A specialized wood splitting tool and handle attachment for a striking hand tool. The splitting tool uses leverage in addition to downward momentum of the cutting head to split wood. The metal handle and metal cutting head are preferably formed from a single piece of steel, in a perpendicular configuration similar to an adz. A splitting wedge blade within the handle exerts transverse shear forces to enhance splitting, and flat top surfaces of the cutting head and the handle near the joint provide a striking surface. A particularly advantageous handle extension attachment is disclosed that may be used with other striking hand tools as well as the wood splitting tool. A woodsman's hatchet that provides an additional blade perpendicular to a splitting wedge blade is also disclosed.

16 Claims, 8 Drawing Sheets

(56) References Cited

U.S. PATENT DOCUMENTS 653,558 A 7/1900 Johnson et al.
660,204 A 10/1900 Seelye
D35,758 S 2/1902 Moffitt
712,942 A 11/1902 Lawton
720,010 A 2/1903 Eiden
732,036 A 6/1903 Best
735,268 A 8/1903 Keehme
736,435 A 8/1903 Parbel
776,734 A * 12/1904 Fuller ..... B26B 23/00 30/308.1
790,973 A 5/1905 Oliver
806,515 A 12/1905 Baumgartner
838,405 A * 12/1906 Henkel ..... A01B 1/20 30/308.1
854,891 A 5/1907 Hoffman
934,008 A * 9/1909 Olson ..... B26B 23/00 30/308.1
1,021,931 A 4/1912 James
1,034,256 A 7/1912 Landro
1,185,250 A 5/1916 Seelye
1,264,776 A * 4/1918 Cox ..... B26B 23/00 30/308.1
1,280,465 A * 10/1918 Herron ..... A01B 1/20 30/308.1
1,336,185 A * 4/1920 Bantjes ..... B25G 3/02 30/308.1
1,398,850 A 11/1921 Franco
1,404,660 A * 1/1922 Shugart ..... B26B 23/00 30/308.1
1,545,228 A 7/1925 Bartran
1,587,767 A 6/1926 Fatico
1,598,279 A 8/1926 Hobbs
1,643,861 A * 9/1927 Szakacs ..... B26B 23/00 30/308.1
1,707,787 A 4/1929 Estwing
2,005,176 A 8/1935 Arbukle
2,105,239 A 1/1938 Bachtold
D123,051 S 10/1940 Farmer
2,280,463 A 4/1942 Williamson
2,377,730 A * 6/1945 Vosbikian et al. ..... B25F 1/04 30/308.1
D155,287 S 12/1947 Hawes
D157,123 S 2/1950 Boeye
2,559,689 A 7/1951 Truesdell
2,576,869 A 11/1951 Woltemath
2,717,442 A 9/1955 Smith
2,804,109 A 8/1957 Falica
D186,972 S 12/1959 Unsinn
3,116,796 A 1/1964 Miljan
3,219,316 A * 11/1965 Fried ..... B25F 1/00 30/308.1
3,245,094 A 4/1966 Shandel
3,252,489 A 5/1966 Huston et al.
3,321,783 A 5/1967 Ivan
3,352,335 A 11/1967 Koski
3,355,226 A * 11/1967 Portz ..... B25G 3/02 81/20
3,366,981 A * 2/1968 Bernard ..... B26B 23/00 30/308.1
3,439,420 A 4/1969 Erickson
3,561,023 A 2/1971 Shandel
3,604,028 A 9/1971 Wardwell
3,627,007 A 12/1971 Rieffer
3,712,659 A 1/1973 Kneissi
3,735,434 A * 5/1973 Penberthy ..... A63B 29/08 30/308.1
3,824,641 A * 7/1974 Shandel ..... B25F 1/02 403/373
3,837,023 A 9/1974 Spencer-Foote
D233,405 S 10/1974 Frey
3,882,560 A 5/1975 Carrer
4,037,668 A 7/1977 Svejda
D248,360 S 7/1978 Graves
4,114,216 A 9/1978 Gatby
4,139,930 A * 2/1979 Cox ..... B25D 1/00 30/308.1
4,175,601 A 11/1979 Meyer
4,181,166 A * 1/1980 Jones ..... B26B 23/00 30/308.1
4,300,606 A 11/1981 Branson
D264,798 S * 6/1982 Jones ..... D8/76
4,381,809 A 5/1983 Kenjorski
4,519,108 A * 5/1985 Hodgson ..... B25F 1/00 30/151
4,586,258 A 5/1986 Burke
4,682,417 A * 7/1987 Henslin ..... B27L 7/00 30/121
4,727,609 A 3/1988 Smith, Jr.
D299,412 S * 1/1989 Zabarte ..... D8/76
D300,001 S 2/1989 Oberg
D301,679 S 6/1989 Kokkinos
D303,068 S * 8/1989 Zabarte ..... D8/10
5,009,010 A * 4/1991 Burlison ..... B26B 23/00 30/308.1
5,020,225 A 6/1991 Stellrecht
5,105,493 A 4/1992 Lugtenaar
D341,070 S 11/1993 Warren
5,297,306 A 3/1994 Shandel
D379,141 S 5/1997 Cleghorn
D382,187 S 8/1997 Hibben
5,701,675 A 12/1997 Hail et al.
5,709,031 A 1/1998 Van Beek
5,768,956 A 6/1998 Coonrad
D429,126 S 8/2000 Murdukhayev
6,295,902 B1 * 10/2001 Lin ..... B25G 1/10 81/177.1
6,357,067 B1 3/2002 Jones
6,494,119 B1 * 12/2002 Coonrad ..... B25D 1/00 81/20
6,516,687 B1 2/2003 Hile et al.
6,564,849 B1 5/2003 Kusner
6,615,691 B2 * 9/2003 Coonrad ..... B25D 1/00 81/20
6,644,639 B1 11/2003 Newton
D501,380 S 2/2005 Sandoval
6,901,822 B2 * 6/2005 Boys ..... B25D 1/045 30/308.1
D522,340 S 6/2006 Hung
7,143,667 B2 * 12/2006 Deros ..... B25D 1/045 81/20
7,181,994 B2 * 2/2007 Norton ..... B25D 1/00 81/20
D546,142 S 7/2007 Christensen
D572,993 S 7/2008 Baty et al.
7,472,484 B2 1/2009 Smilanich
D595,554 S 7/2009 Hardinge
8,424,212 B2 * 4/2013 Clarke ..... B26B 23/00 30/308.1
D690,181 S * 9/2013 Sykes ..... D8/76
2003/0110643 A1 6/2003 Wickline
2004/0261188 A1 12/2004 Mathis
2006/0009144 A1 1/2006 Frieswick et al.
2007/0144016 A1 6/2007 Luo
2007/0209483 A1 * 9/2007 Chen ..... B25D 1/045 81/20
2007/0227050 A1 * 10/2007 Brown ..... E02F 5/02 37/347
2008/0303199 A1 12/2008 DiNatale
2010/0139008 A1 * 6/2010 Janzen ..... B26B 23/00 30/308.3
2012/0304474 A1 * 12/2012 Moore ..... B26B 23/00 30/308.1
2014/0261892 A1 * 9/2014 Clarke ..... B27L 7/005 30/308.1

FOREIGN PATENT DOCUMENTS

EP WO9716289 5/1997
FR 597743 11/1925

(56) References Cited

FOREIGN PATENT DOCUMENTS

| | | | | |
|---|---|---|---|---|
| FR | 2541173 | | | 2/1983 |
| GB | 839117 | A | * | 6/1960 |
| SE | 9500896 | | | 9/1996 |

* cited by examiner

APPARATUS FOR SPLITTING WOOD INTO KINDLING

CROSS-REFERENCE TO RELATED APPLICATION

This application is a divisional of, and claims the benefit of, U.S. patent application Ser. No. 14/712,739, filed on May 14, 2015, which is a continuation-in-part of, and claims the benefit of, U.S. patent application Ser. No. 13/843,064, filed on Mar. 15, 2013, which is a continuation-in-part of, and claims the benefit of, U.S. patent application Ser. No. 12/507,021, filed on Jul. 21, 2009, which issued as U.S. Pat. No. 8,424,212 on Apr. 23, 2013, all of which are hereby incorporated by reference in their entireties.

TECHNICAL FIELD

Embodiments of the present invention relate to manual tools for splitting or chopping wood.

BACKGROUND

Hand tools used to cut wood through the ages often have taken the form of an axe, an adz, or a splitting wedge used with a blunt sledge hammer. Each type of tool has features that are useful for different purposes, but each tool also has certain limitations. For example, an axe or hatchet has a metal blade in line with the handle, a useful configuration for efficiently exerting a downward force to split relatively small logs with a single blow. However, if the single blow is not energetic enough to split the wood, the axe may become stuck in the wood. Dislodging an axe stuck in a piece of wood is an awkward, unpredictable, and risky activity. Larger logs benefit from the use of splitting wedges in which a wedge having a sharp blade is separate from a blunt sledge hammer used to safely drive the wedge into the wood with multiple blows. If the wedge gets stuck, a second or even a third wedge may be driven into the same piece of wood to multiply the splitting force. Drawbacks of such a "sledge and wedge" system include the weight of the sledge hammer and suitability for larger pieces of wood as opposed to kindling. An adz is another conventional cutting tool that uses a chisel or gouge-shaped blade for hewing and shaping timber. The adz features an axe blade oriented perpendicular to the handle, similar to a garden hoe, instead of in line with the handle, like a standard axe. Most existing wood-splitting tools are variations of these three well known forms, featuring a variety of different cutting head shapes, handle forms, and methods of attaching the blade to the handle.

SUMMARY

A novel splitting tool and a specialized chopping block described herein cooperate to enable kindling to be cut from ordinary firewood in an efficient and safe manner with a minimal application of force. The splitting tool applies leverage in addition to downward momentum of the cutting head to split wood. Extra leverage becomes possible with the use of a metal handle integrated with a metal cutting head, the cutting head and handle being formed or attached in a perpendicular configuration similar to an adz. However, the splitting tool differs from a conventional axe or adz in a number of respects. In addition to the all-metal construction, a widening profile of the handle near the cutting head has a unique triangular shape, thereby increasing the amount of leverage that may be applied to the wood. A secondary cutting blade is integrated into the end of the handle near the cutting head to split wood away from the face of the cutting head, thereby preventing the tool from getting stuck in the wood. In addition, the integrated flat top surfaces of the cutting head and the handle near the joint allow the user to drive the cutting head completely into the wood as though the cutting head were splitting wood.

The splitting tool is complemented by a specialized chopping block for holding wood in a steady, upright position. The chopping block features a V-shaped recess that is open on one end, allowing the user to slide a kindling log into the recessed platform until it is sufficiently braced, thereby accommodating kindling logs of various diameters.

The chopping block also provides resistance to the downward force of the splitting tool during the splitting action.

A novel attachment for connecting a handle extension to a striking hand tool having a head, a handle shaft, and an elongate handle extension is also provided. The head has a first dimension along which the head is adapted to transfer striking force and a second dimension, non-parallel to the first dimension, along which the handle shaft extends away from the head The handle extension has an attachment end, a grip end, a top portion and a bottom portion. The attachment comprises a top tang and a bottom tang extending away from the handle shaft nominally in a plane defined by the first dimension and the second dimension of the head. The tangs are spaced from one another in that plane.

A top groove is formed in the top portion of the handle extension so as to extend longitudinally from the attachment end toward the grip end of the handle extension for receiving the top tang, and a bottom groove is formed in the bottom portion of the handle extension so as to extend longitudinally from the attachment end toward the grip end of the handle extension for receiving the bottom tang. The spacing between the top groove and the bottom groove is such that the attachment end of the handle extension may be inserted longitudinally into the handle shaft whereby the top tang is disposed in the top groove and the bottom tang is disposed in the bottom groove. At least one fastener is provided for attaching the top tang to the handle extension and the bottom tang to the handle extension.

A woodsman's hatchet is also provided. The woodsman's hatchet comprises a cutting head and handle, or handle shaft. The cutting head has a primary, or first, cutting blade. A secondary, or second, cutting blade integrated into an end of the handle near the cutting head on the same side of the handle as the first cutting blade. The cutting head also has a third cutting blade at an end of the cutting head opposite the first cutting blade. The first cutting blade is perpendicular to the elongate axis of the handle shaft, and the third cutting blade is perpendicular to the first cutting blade.

It is understood that this summary is provided as a means for generally determining what follows in the drawings and detailed description, and is not intended to limit the scope of the invention. The foregoing and other objects, features and advantages of the invention will be readily understood upon consideration of the following detailed description taken in conjunction with the accompanying drawings.

DETAILED DESCRIPTION OF EMBODIMENTS OF THE INVENTION

Figure 1:
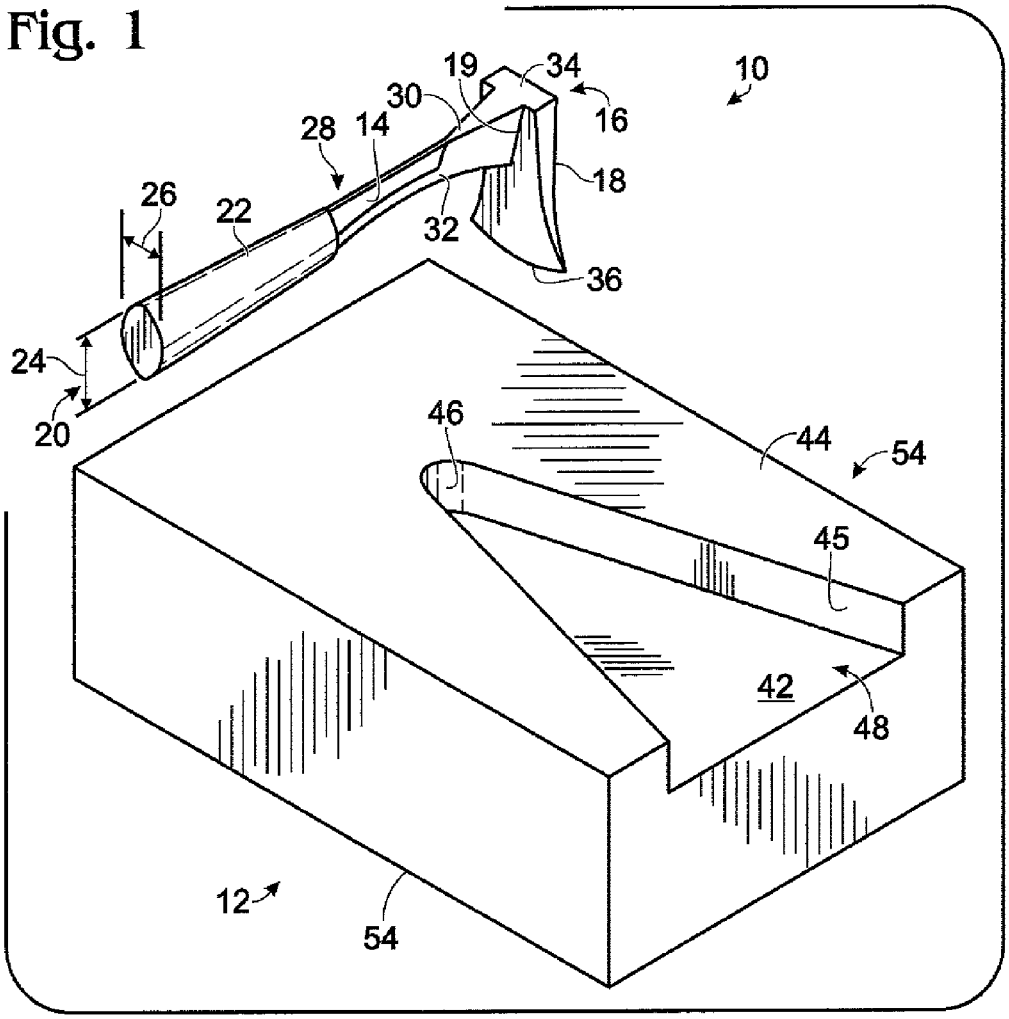
FIG. 1 is a perspective view of a first embodiment of a splitting tool and chopping block system, in accordance with a preferred embodiment.

FIG. 1 shows a perspective view of the two components described herein: a first embodiment of a splitting tool 10, and a chopping block 12, shown in approximate proportion to each other. The splitting tool 10 comprises a handle shaft 14, and, attached perpendicularly to a distal end 16 of the handle shaft 14, a tapered cutting head 18. Both handle shaft 14 and cutting head 18 are preferably made of steel and are preferably forged or cast into one continuous steel piece to maximize strength at a joint 19, though joint 19 generally may be formed by welding, soldering, or another method of attachment. At a proximal end 20 of handle shaft 14, opposite cutting head 18, steel handle shaft 14 is preferably partially surrounded by a rubber grip 22, covering about half the length of handle shaft 14, the rubber grip 22 providing both user comfort and impact resistance. Proximal end 20 of handle shaft 14 has an oblong profile that tapers along its length toward a mid-section 28 at which the rubber grip 22 ends.

Beyond mid-section 28, toward distal end 16, the cross section of handle shaft 14 widens near joint 19 to a shape that surrounds a broad, flat, top handle shaft striking surface 30 and a tapered secondary cutting blade 32 on the underside of handle shaft 14 to assist the cutting head 18 in splitting wood. Secondary cutting blade 32 structurally reinforces joint 19 to better withstand the forces generated when prying wood apart. The butt, or top surface, of cutting head 18 is also formed into a flat plane, providing a clean striking surface 34 opposite a primary cutting blade 36. In a preferred embodiment, striking surfaces 30 and 34 form a single, integrated flat plane. If primary cutting blade 36 should become lodged in the wood (because of the presence of knots, for example), removing cutting head 18 is made easier by the availability of the striking surfaces 30 and 34. By striking these flat surfaces with a mallet or other weighty object, an additional downward force is supplied to either finish splitting the wood by prying it apart, or to free cutting head 18 for another attempt.

FIG. 1 also shows a perspective view of the solid wood rectangular chopping block 12, having as its principal feature a V-shaped recessed platform 42, cut from its top surface 44. According to a preferred embodiment, recessed platform 42 has straight recessed walls 45 and a rounded point 46 opposite an open end 48. For example, a kindling log may be slid through open end 48, and wedged into rounded point 46 in an upright position for processing.

Figure 2:
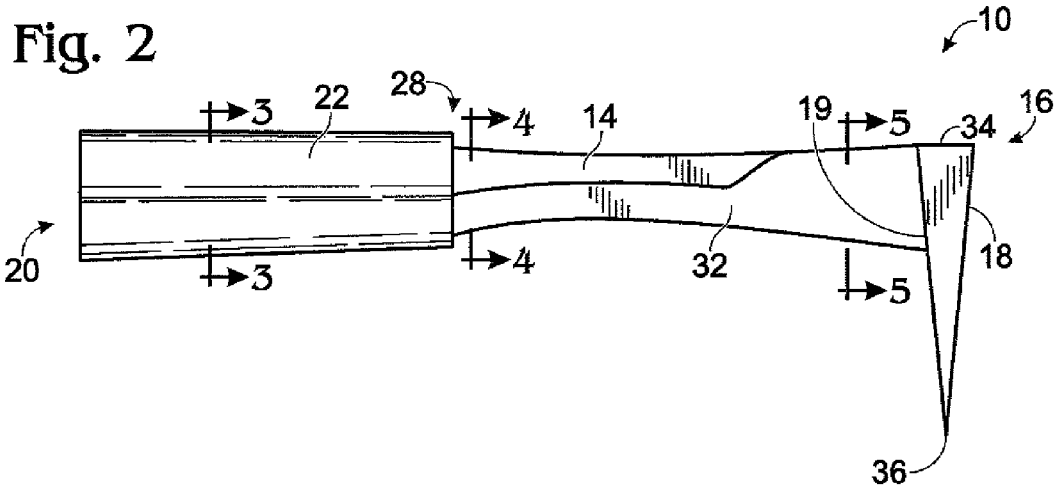
FIG. 2 is a side view of the first embodiment of the splitting tool showing the cutting head, handle, and joints as well as cut lines corresponding to cross sectional views shown in FIGS. 3-5.

FIG. 2 shows a side view of splitting tool 10 having three sets of cut lines to demonstrate variations in the cross-sectional profile along the length of handle shaft 14. According to a preferred embodiment, approximate dimensions of handle shaft 14 include a circumference of about 3 inches, and a total length of about 10 inches, of which a sharp edge on secondary cutting blade 32 extends about three inches from joint 19 toward proximal end 20.

Figure 3:
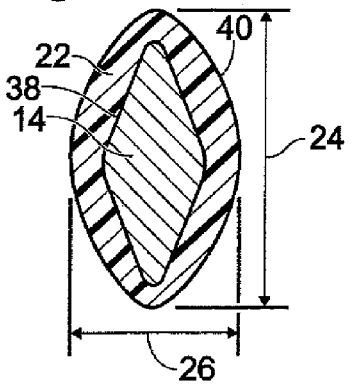
FIG. 3 is a cross-sectional view of the steel handle shaft and rubber grip of the first embodiment of the splitting tool along a cut line 3-3, shown in FIG. 2.
Figure 4:
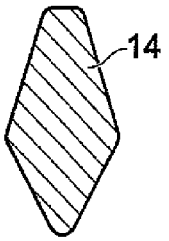
FIG. 4 is a cross-sectional view of the steel handle shaft of the first embodiment of the splitting tool along a cut line 4-4, shown in FIG. 2.
Figure 5:
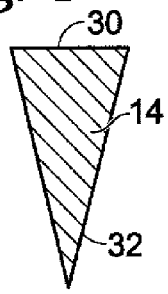
FIG. 5 is a cross-sectional view of the steel handle shaft near the cutting head, of the first embodiment of the splitting tool along a cut line 5-5, shown in FIG. 2.

FIGS. 3-5 show specific cross-sectional profiles along cut lines 3-3, 4-4, and 5-5, respectively, shown in FIG. 2. FIGS. 3 and 4 show that the oblong profile at proximal end 20 is preferably oriented so that its vertical dimension 24 exceeds its horizontal dimension 26, and that steel handle shaft 14 has a profile in a rounded diamond shape 38. FIG. 3 additionally shows that the rubber grip 22 surrounding the proximal end 20 of handle shaft 14 causes the overall form of the handle to have an oval shape 40. At mid-section 28 of the steel handle shaft 14, beyond the end of rubber grip 22, the profile simply comprises the core rounded diamond shape 38. The cross-sectional profile of steel handle shaft 14 near distal end 16 tapers to a point at the bottom, and the flat top gradually widens toward joint 19, totaling an elongated triangular shape shown in FIG. 5.

Figure 6:
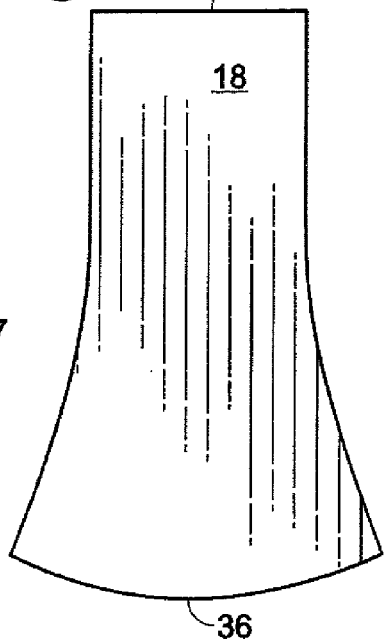
FIG. 6 is a front view of the cutting head of the first embodiment of the splitting tool.

FIG. 6 is an end view of the four-sided cutting head 18 showing the primary cutting blade 36, the convex curve of the blade profile having a radius of curvature of about 3 inches. According to a preferred embodiment, cutting head striking surface 34, opposite primary cutting blade 36 is about 1.75 inches wide and 0.75 inches deep, providing ample surface area for use as a striking surface in conjunction with surface 30 on handle shaft 14. Cutting head 18 is preferably about 4.75 inches long. The sides of cutting head 18 are contoured in a concave curve having about a 5 inch radius of curvature. As cutting head 18 is driven into the wood, secondary cutting blade 32 on the bottom of the handle opens a second split at a right angle to the main split initiated by primary cutting blade 36 on cutting head 18. This action exerts transverse shear forces on the wood to enhance the splitting. The mechanical advantage of the secondary cutting blade 32 used as a lever, in cooperation with primary cutting blade 36, splits apart even hard, dense wood with relatively little effort.

Figure 7:
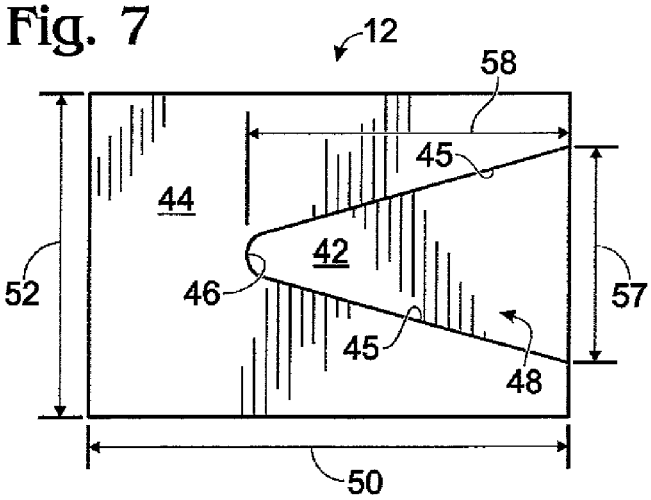
FIG. 7 is a top view of the chopping block shown in FIG. 1 in accordance with a preferred embodiment.
Figure 8:
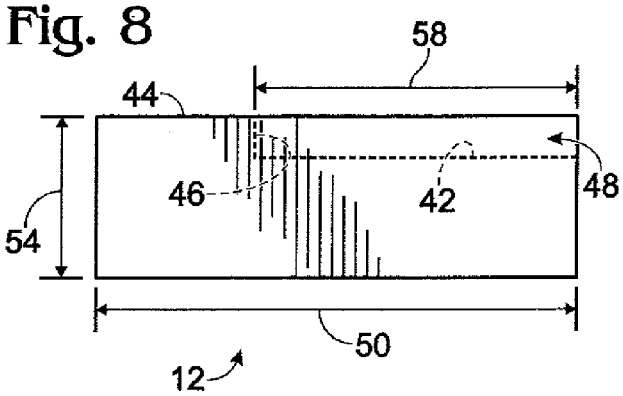
FIG. 8 is a front view of the chopping block shown in FIG. 1.
Figure 9:
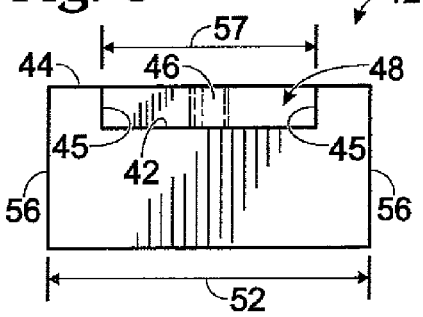
FIG. 9 is a cross-sectional view of the chopping block shown in FIG. 1.

FIGS. 7-9 pertain to chopping block 12, a specialized embodiment that complements splitting tool 10, to complete a wood chopping system for kindling. FIG. 7 provides a top view of the solid wood rectangular chopping block 12, preferably having approximate outer dimensions including a length 50 of 1.5 ft, a width 52 of 1.0 ft, and a thickness 54 of 6 inches. According to a preferred embodiment, V-shaped recessed platform 42 is cut from one end of chopping block 12 and positioned symmetrically with respect to the width 52 of chopping block 12. V-shaped recessed platform 42 preferably has straight sides 56 measuring about 12 inches, and is cut to a depth of about 1.5 inches. Open end 48 preferably has a width 57 of about 8 inches, leaving 2 inches of the solid chopping block 12 raised about the recessed platform 42 on either side. Likewise, the projection 58 of each of sides 56 along the length 50 of the chopping block 12 is preferably also about 8 inches. Recessed platform 42 provides a secure base to hold a subject piece of wood steady for splitting by splitting tool 10, and a means of resisting the additional leverage imparted to the wood through the use of tapered secondary cutting blade 32.

FIGS. 10-14 show a second embodiment of a splitting tool. Referring primarily, but not exclusively, to FIG. 10, splitting tool 100 has a cutting head 102, a handle 104 and a handle extension 106. The cutting head has a first cutting edge 108, and the handle 104 and handle extension 106 are substantially perpendicular to the first cutting edge. The bottom of the handle has a second cutting edge 110 that is also perpendicular to the first cutting edge 108.

In addition to the first cutting edge, the cutting head comprises a top portion 112, having a front face 114 and a back face 116 that are preferably essentially parallel to one another. "Essentially" is used herein to mean that, while not necessarily precisely parallel, the top portion would be understood to be of uniform thickness from front to back as a practical matter. However, it is to be understood that, while the use of a top portion having uniform thickness is desirable for cutting head strength, a non-uniform thickness may be used without departing from the principles of the invention. The cutting head also comprises a middle portion 118, having a front surface 120 and a back surface 122 that taper from the front surface 114 and back surface 116 of the top portion toward the first cutting edge 108. The cutting edge is formed to be sharp, as for example by grinding the bottom edge of the cutting head.

Figure 11:
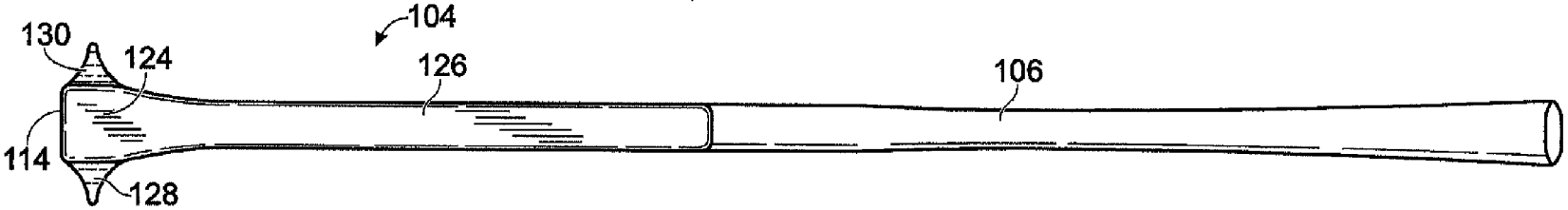
FIG. 11 is a top view of the second embodiment of the splitting tool shown in FIG. 10.
Figures 12, 13, 14:
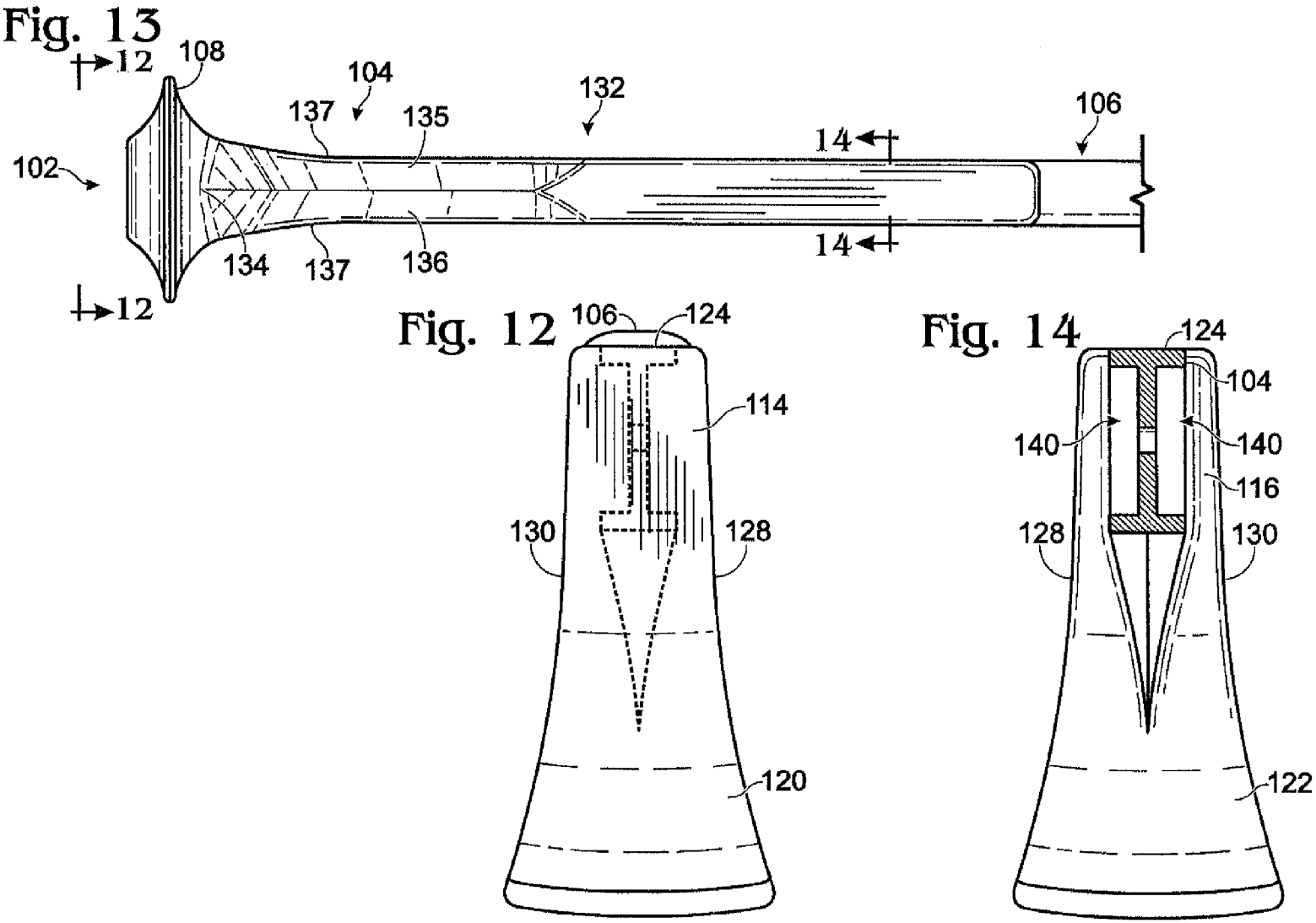
FIG. 12 is a front view of the second embodiment of the splitting tool shown in FIG. 10.
FIG. 13 is a bottom view of the second embodiment of the splitting tool shown in FIG. 10.
FIG. 14 is an end view of the cutting head with the handle extension removed.

Referring to FIGS. 11 and 12 in particular, the cutting head preferably has a flat portion 124 opposite the first cutting blade 108. This facilitates the application of impulses of force to the cutting head when it is wedged into a piece of wood, for example by striking it with a piece of kindling. To this end, it is preferred that the flat portion 124 of the cutting head actually extends along the top 126 of the handle 104. The cutting head further comprises a first side 128 and a second side 130, which taper outwardly from the top of the cutting head to the first cutting edge 108 at the bottom of the cutting head.

Figure 10:
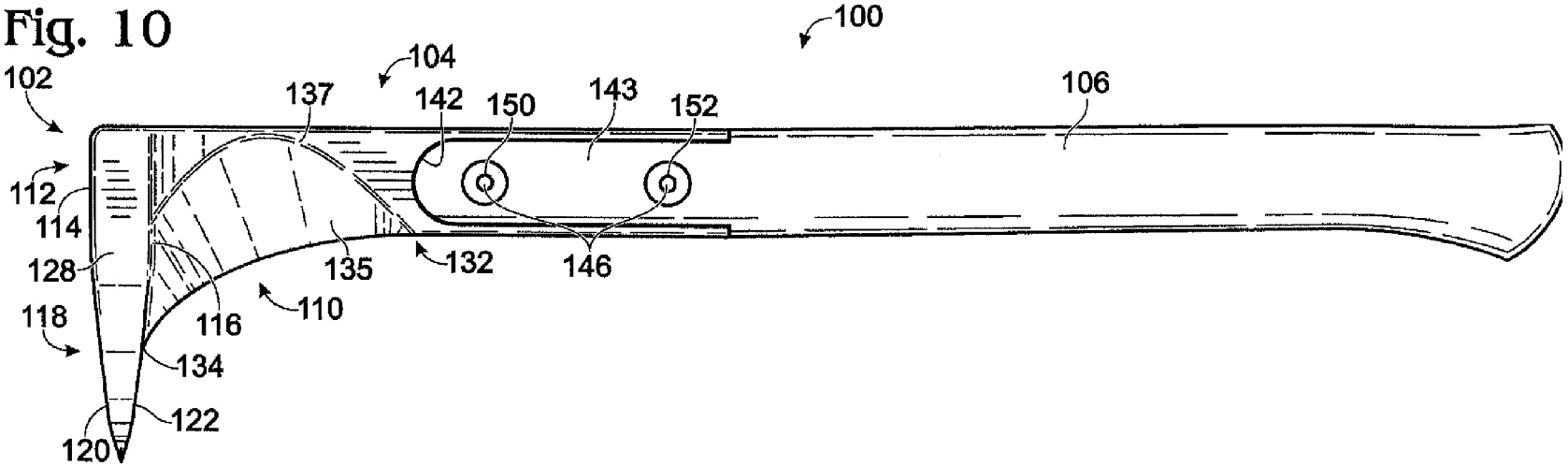
FIG. 10 is a side view of a second embodiment of the splitting tool showing a cutting head including a handle, and a handle extension attached to the cutting head.

Turning to FIG. 10 and FIG. 13 in particular, the second cutting blade, which is disposed on the bottom of the handle 104 starts at the bottom of the handle spaced at a location 132 away from the cutting head and extends arcuately toward the cutting head terminating at a location 134 lower than the bottom of the handle. The two side surfaces 135, 136 taper away from the second cutting edge and from one another to form arcuate surface transitions 137 in both sides of the handle.

It has been found that, while it is preferable for strength that the cutting head and handle be made of metal, such as steel, it is also preferable that the handle extension 106 be made of wood, or material having strength and resiliency characteristics similar to wood, such as suitable plastic, fiberglass or carbon fiber material, for example. The integral metal cutting head and handle also provide an advantage over other impact hand tools that employ a handle, typically made of wood, connected to a separate head having a hole, or eye, in which an end of the handle is inserted for attachment to the head. The advantage is that while an eye in the head will weaken the head's ability to withstand blows from the top, such as those that can be the result of using a hammer to drive the cutting blade further into wood, that is not the case with the integral head and cutting blade.

In this second embodiment, the handle includes recesses 140 on both sides thereof, as shown by FIG. 14, which produces an "I" shaped cross section at the rear portion of the handle. Preferably, the recesses terminate adjacent the beginning of the second cutting blade with semi-circular ends 142. The handle extension is then attached by a slotted end 143 that fits into the recesses and is held in place by threaded fasteners 146 passing through apertures 150 and 152, respectively, in the handle and handle extension.

Figure 15:
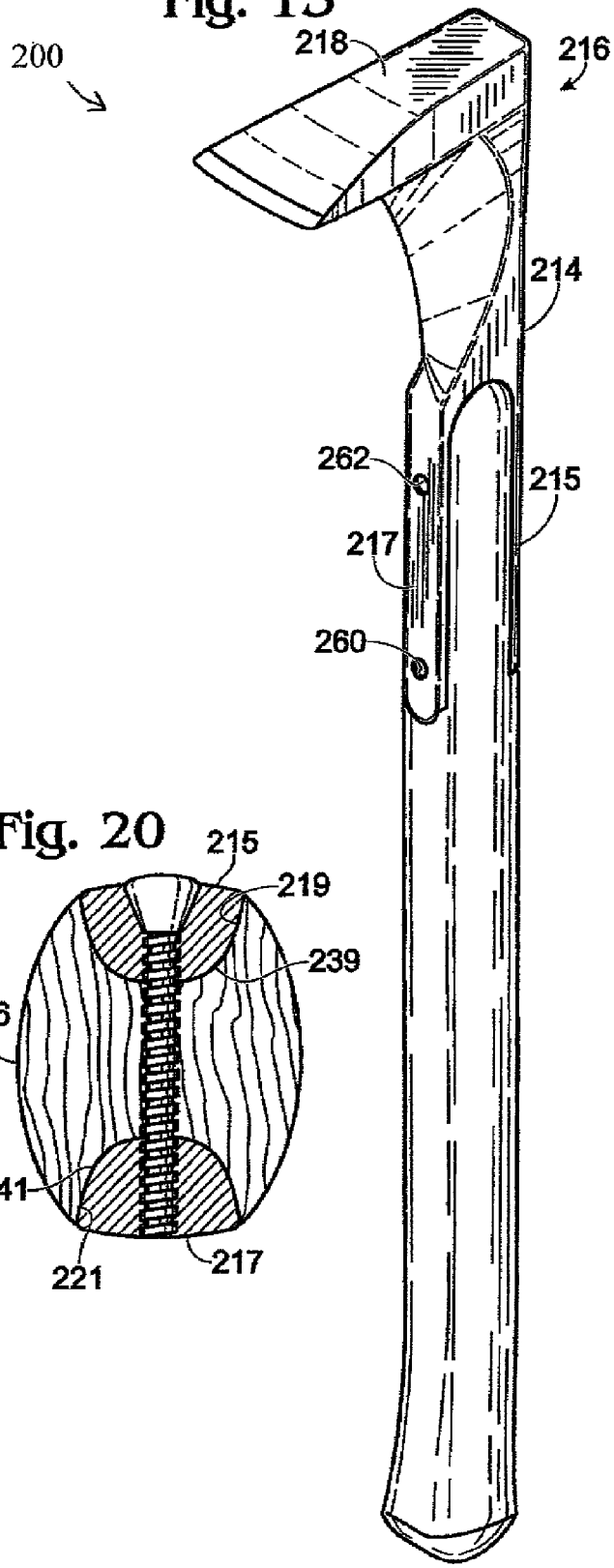
FIG. 15 is a perspective view of a third embodiment of a splitting tool having an alternative attachment for connecting a handle extension to the head of a striking hand tool.
Figure 19:
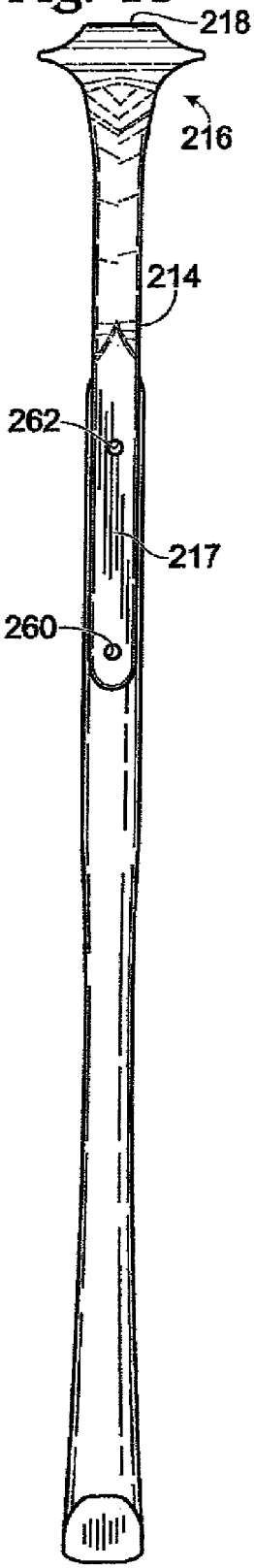
FIG. 19 is a bottom view of the embodiment of a splitting tool shown in FIG. 15.
Figure 20:
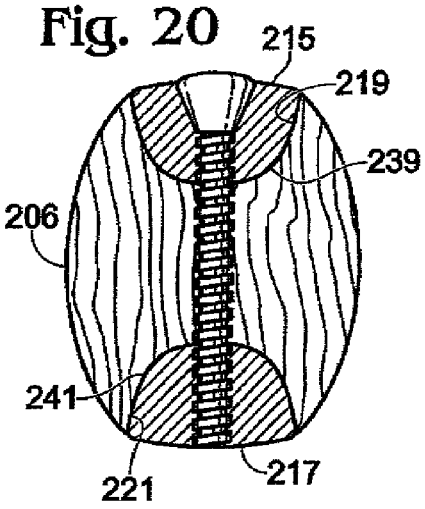
FIG. 20 is a cross-section of the embodiment of a splitting tool shown in FIG. 15, taken along the line 20-20 of FIG. 17.
Figure 16:
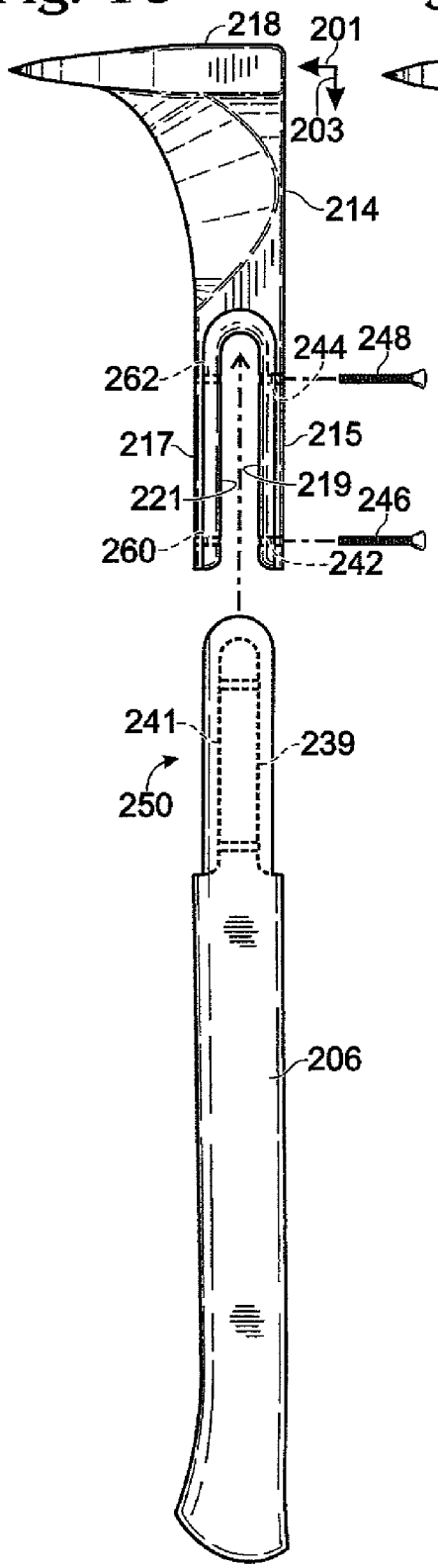
FIG. 16 is a side, exploded view of the embodiment of a splitting tool shown in FIG. 15.
Figure 17:
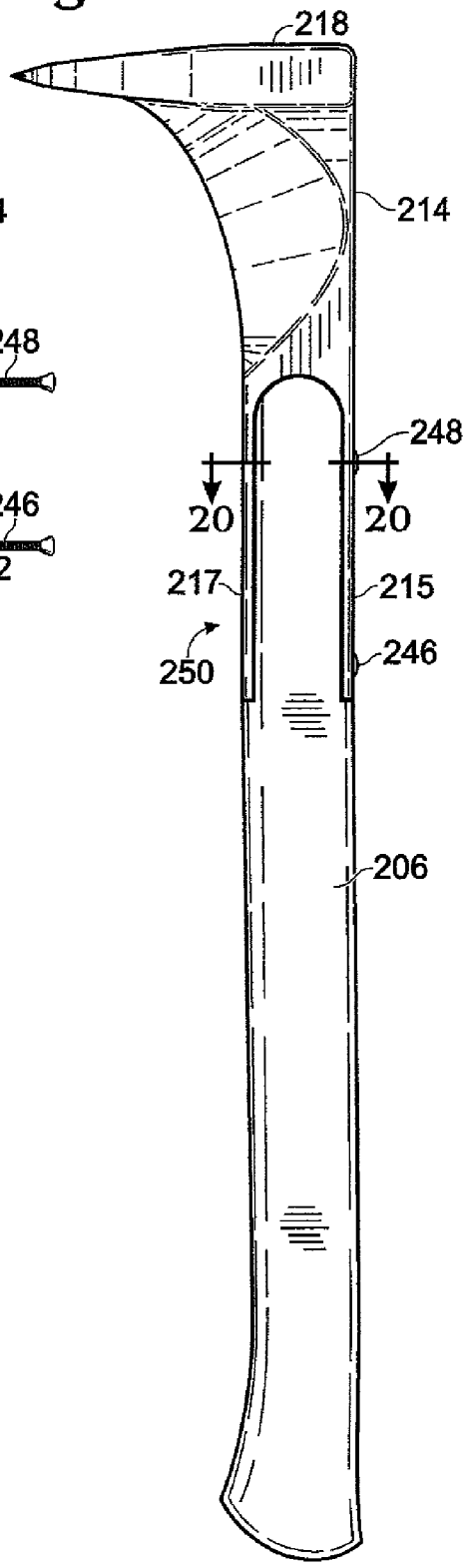
FIG. 17 is a side view of the embodiment of a splitting tool shown in FIG. 15.
Figure 18:
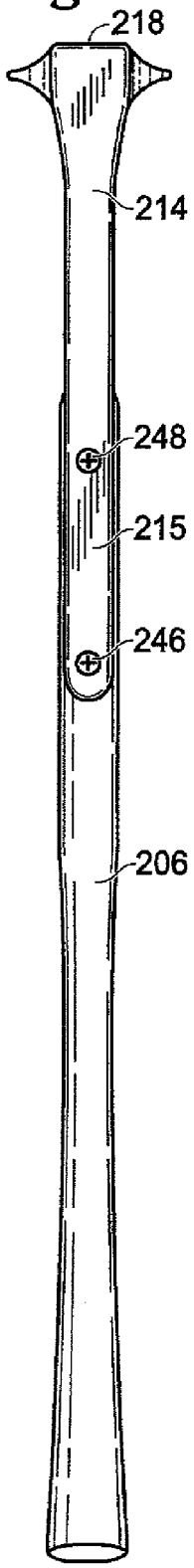
FIG. 18 is a top view of the embodiment of a splitting tool shown in FIG. 15.

Turning now to FIG. 15, a third embodiment of a splitting tool 200 comprises a handle shaft 214 and, attached perpendicularly to a distal end 216 of the handle shaft 214, a tapered cutting head 218 similar to the cutting head shown in FIGS. 10 and 11. However in this case the handle shaft 214 terminates in a "U" shaped portion, viewed from the side as shown in FIGS. 15, 16 and 17, having a top tang 215 and a bottom tang 217, the cross sections of each tang being generally "D" shaped with the convex portions 219 and 221 of the top and bottom tangs, respectively, both being inwardly directed toward a handle extension 206, as shown in FIG. 20. The handle extension is preferably made of wood or a synthetic material. Referring to FIG. 16, for orientation purposes dimension 201 can be considered the dimension along which the head is adapted to transfer striking force and a second dimension 203, which is non-parallel to the first dimension, can be considered the dimension along which the handle shaft extends away from the head. Typically dimension 203 would be substantially perpendicular to dimension 201, though a significant deviation from perpendicular may not defeat the purposes of the subject matter disclosed herein.

In this case, the handle extension has a top groove 239 and a bottom groove 241 into which the top tang 215 and the bottom tang 217, respectively, fit so as to form a joint between the handle shaft 214 of the cutting head and the handle extension, as particularly shown in FIGS. 16, 17 and 20. It may be noted from FIG. 20 that the tangs 215 and 217 and the grooves 239 and 241 have mating surfaces configured so that one of the mating surfaces nests in the other. Accordingly, both the tangs and the grooves may be referred to generically as "nesting structures." In addition, the tangs are outwardly disposed relative to the grooves, so the tangs may be referred to more specifically as "outer nesting structures" with the grooves being referred to more specifically as "inner nesting structures." The top tang 215 includes at least one aperture for receiving at least one fastener, but preferably two apertures 242 and 244 are provided for passing respective fasteners 246 and 248 there through. Similarly, the grooved portion 250 of the handle extension 206 preferably includes respective apertures 252 and 254 for receiving fasteners 246 and 248, and the bottom tang also preferably includes apertures 260 and 262 for receiving fasteners 246 and 248, respectively, as particularly shown in FIG. 16.

Preferably the fasteners 246 and 248 are threaded fasteners that slip through apertures 242 and 244, respectively, of the top tang 215, and through apertures 252 and 254, respectively, of the grooved portion 250 of the handle extension 206 and engage the apertures 260 and 262 of the bottom tang 217, having complementary threads, to firmly attach the handle extension 216 to the handle shaft 214. However, it is to be understood that other types of fasteners, including bolt and nut combinations as well as opposing wood screws could be used.

The tang, groove and fastener interlocking attachment mechanism described above with respect to FIGS. 15 through 20 which feature the cutting head 218, can also be used with other hand tool striking, or impact, tools. This is because, among other things, it resists torque in all directions, typically produced when exerting leverage with such a tool when it has penetrated an object, while only producing minimal shear force on the threaded fasteners.

Figure 21:
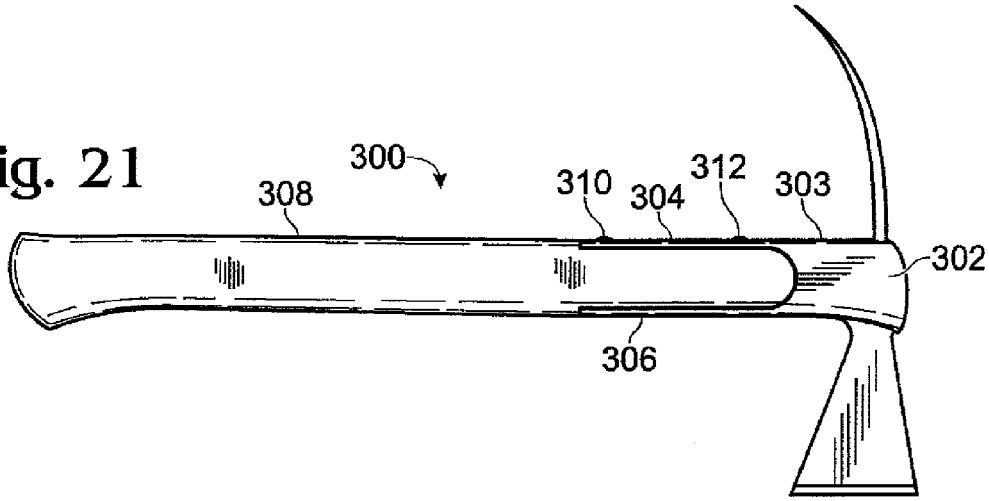
FIG. 21 is a side view of an embodiment of a mattock employing the attachment shown in FIGS. 15-20.
Figure 22:
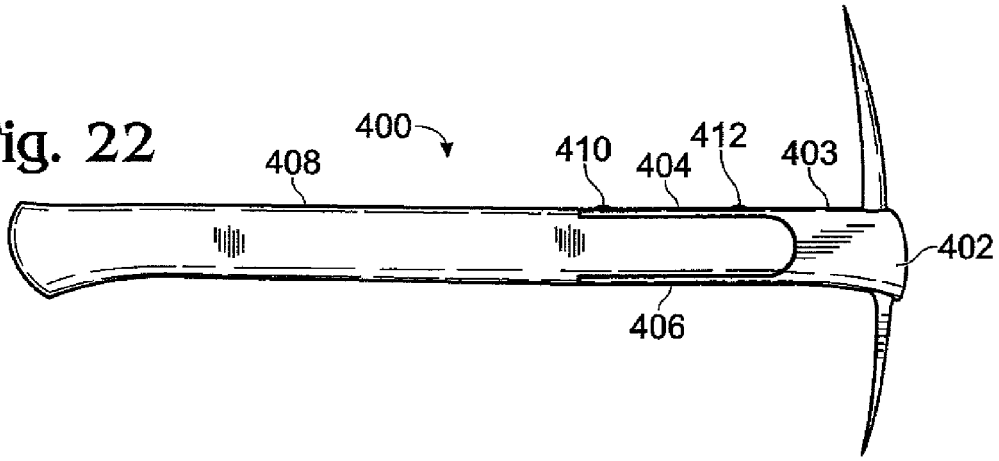
FIG. 22 is a side view of an embodiment of a pick axe employing the attachment shown in FIGS. 15-20.
Figure 23:
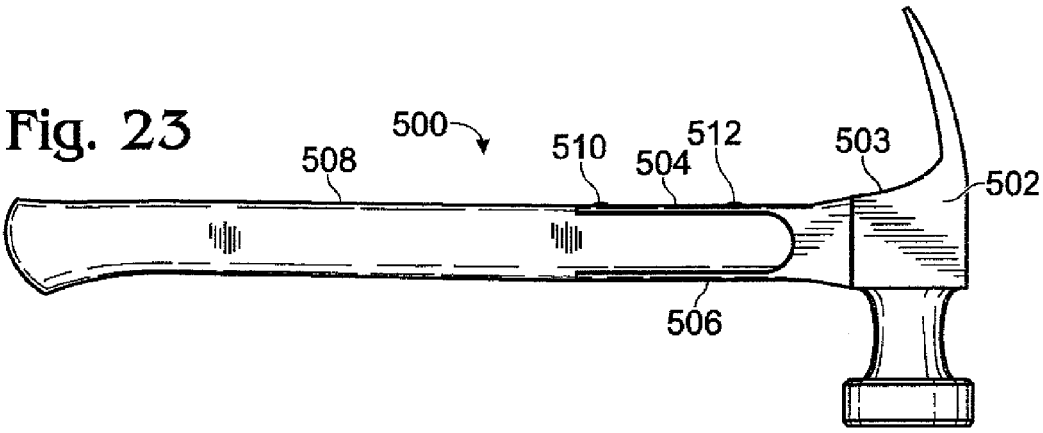
FIG. 23 is a side view of an embodiment of a hammer employing the attachment shown in FIGS. 15-20.

For examples, such devices include, but are not limited to, a mattock 300, comprising a mattock head 302 having a handle shaft 303 including top and bottom tangs 304 and 306, respectively, and a grooved handle extension 308 held in place by fasteners 310 and 312, as shown in FIG. 21; a pick axe 400, comprising a pick axe head 402 having a handle shaft 403 including top and bottom tangs 404 and 406, respectively, and a grooved handle extension 408 held in together by fasteners 410 and 412, as shown in FIG. 22; and a hammer, for example, a claw hammer 500, comprising a hammer head 502 having a handle extension 503 including top and bottom tangs 504 and 506, respectively, and a grooved handle extension 508 held together by fasteners 510 and 512, as shown in FIG. 23. The inclusion of these examples is not intended to be exhaustive or to limit the scope of the claims.

Figure 24:
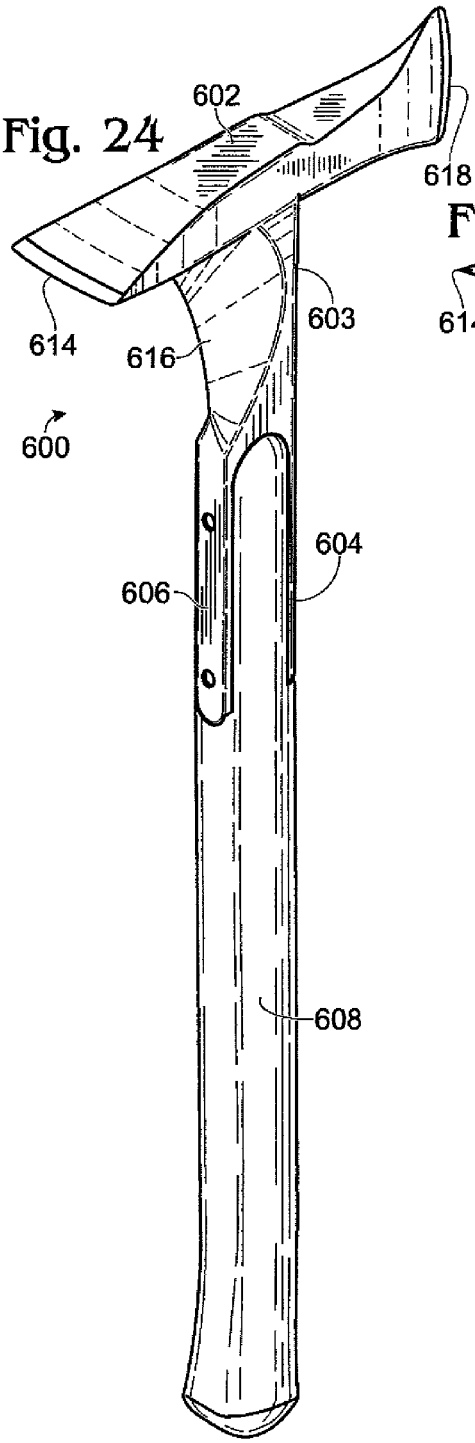
FIG. 24 is a perspective of an embodiment of a woodsman's hatchet employing the attachment shown in FIGS. 15-20.
Figure 25:
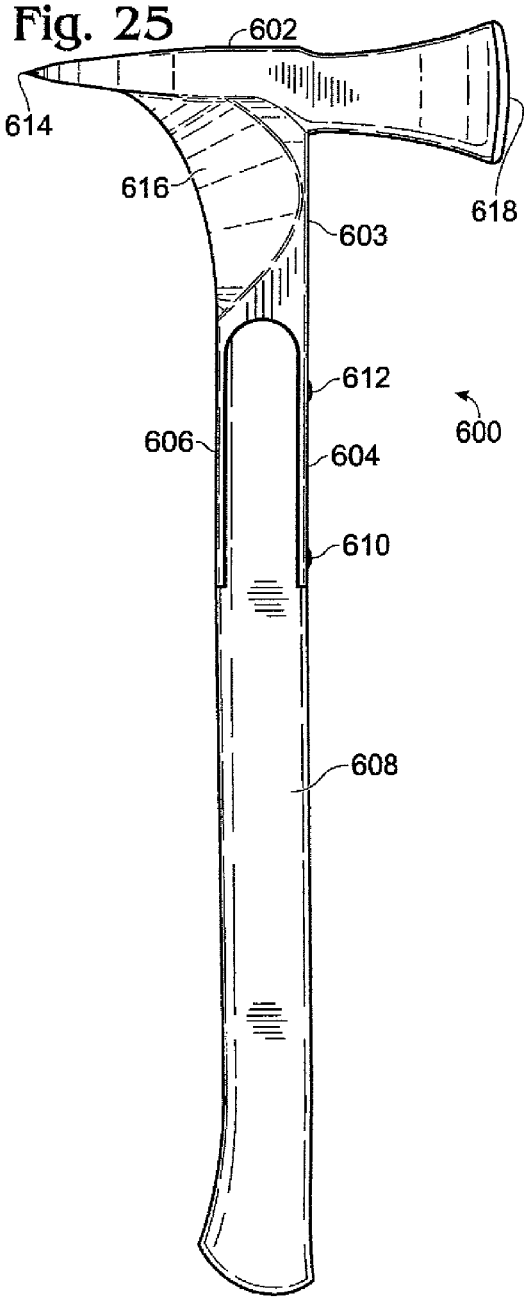
FIG. 25 is a side view of the woodsman's hatchet of FIG. 24.

Turning to FIGS. 24 and 25, an embodiment of a novel woodsman's hatchet 600 is disclosed. The woodsman's hatchet comprises an hatchet head 602 having a handle shaft 603 including top and bottom tangs 604 and 606, respectively, and a grooved handle extension 608 held place by fasteners 610 and 612, as described above with respect to FIGS. 15 through 20. However, in this case the head 602 of the woodsman's hatchet 600 not only has a first cutting blade 614 disposed at one end of the head 602 and oriented substantially perpendicular to the longitudinal axis of the handle shaft 606, and a second cutting blade 616 formed by the handle shaft, as described above with respect to the embodiment of FIGS. 15 through 20, but also has third cutting blade 618 disposed at the other end of the head 602. The third cutting blade 618 is oriented substantially perpendicular to the first cutting blade 614 and substantially parallel to the longitudinal axis of the handle shaft. This enables a user to rotate the axe about the longitudinal axis of the handle shaft so as to facilitate cutting wood faster and also turning wood debris into chips. Preferably, the entire woodsman's hatchet head comprises a single, unitary, metal member.

Although certain embodiments have been illustrated and described herein, it will be appreciated by those of ordinary skill in the art that a wide variety of alternative or equivalent embodiments or implementations calculated to achieve the same purposes may be substituted for the embodiments illustrated and described without departing from the scope of the present invention. Those with skill in the art will readily appreciate that embodiments in accordance with the present invention may be implemented in a very wide variety of ways. This application is intended to cover any adaptations or variations of the embodiments discussed herein.

The terms and expressions which have been employed in the foregoing specification are used therein as terms of description and not of limitation, and there is no intention, in the use of such terms and expressions, to exclude equivalents of the features shown and described or portions thereof, it being recognized that the scope of the invention is defined and limited only the claims that follow.

The invention claimed is:

1. A tool for splitting wood or similar material, comprising:

a cutting head that includes a first cutting blade;

a handle shaft having a longitudinal axis that is substantially perpendicular to the first cutting blade, the handle shaft being joined to the cutting head so as to extend away from the cutting head and define two side surfaces that converge to form a second cutting blade on the same side of the handle shaft as the first cutting blade, the second cutting blade having an arcuate cutting edge, wherein the cutting edge of the second cutting blade becomes closer to the longitudinal axis with increasing distance from the cutting head, the second cutting blade being perpendicular to the first cutting blade so that the combined action thereof, when applied to the wood or similar material, first exerts shear forces substantially perpendicular to the first cutting blade and thereafter substantially perpendicular to said longitudinal axis so as to split the wood or similar material in two directions; and a third cutting blade disposed at an end of the cutting head opposite the end that includes the first cutting blade and being oriented substantially perpendicular to the first cutting blade, so that the tool may readily be rotated about the longitudinal axis so as to more readily exert shear forces to said longitudinal axis.

2. The tool of claim 1, wherein the cutting head is adapted to transfer striking force nominally in a striking direction away from said longitudinal axis and passing through a midpoint of said first cutting blade, the handle shaft having a top tang and a bottom tang which extend away from the head nominally in a plane defined by the striking direction and the longitudinal axis and which terminate at respective distal ends thereof, the top tang having a laterally contoured lower surface and the bottom tang having a laterally contoured upper surface, the top tang and the bottom tang being spaced from one another in said plane, the tool further comprising an elongate handle extension having an attachment end, a grip end, a top portion and a bottom portion, the top portion of the handle extension having a laterally contoured upper surface complementary to the laterally symmetric contoured shape of the lower surface of the top tang extending longitudinally from the attachment end toward the grip end of the handle extension for receiving the lower surface of the top tang, and the bottom portion of the handle extension having a laterally contoured lower surface complementary to the laterally contoured shape of the upper surface of the bottom tang and extending longitudinally from the attachment end toward the grip end of the handle extension for receiving the upper surface of the bottom tang, the spacing between the top tang and the bottom tang being such that the attachment end of the handle extension may be inserted longitudinally into the handle shaft.

3. The tool of claim 2, wherein the upper surface of the top portion of the handle extension has a smoothly curved concave shape, the lower surface of the top tang has a smoothly curved convex shape, the lower surface of the bottom portion of the handle extension has a smoothly curved concave shape, and the upper surface of the bottom tang has a smoothly curved convex shape.

4. The tool of claim 2, further comprising one or more fasteners for securing the top tang to the handle extension and the bottom tang to the handle extension.

5. The tool of claim 1, wherein the cutting edge of the second cutting blade becomes closer to the first cutting blade as it becomes closer to the cutting head and defines a substantially smooth curve with increasing distance from the handle shaft.

6. The tool of claim 5, wherein the cutting head and the handle shaft are made of metal.

7. A tool for splitting wood or similar material, comprising:

a cutting head that includes a first cutting blade;

a handle shaft having a longitudinal axis that is substantially perpendicular to the first cutting blade, the handle shaft being joined to the cutting head so as to extend away from the cutting head and define two side surfaces that converge to form a second cutting blade on the same side of the handle shaft as the first cutting blade, the second cutting blade having an arcuate cutting edge, wherein the cutting edge of the second cutting blade becomes closer to the longitudinal axis with increasing distance from the cutting head, the second cutting blade being perpendicular to the first cutting blade so that the combined action thereof, when applied to the wood or similar material, first exerts shear forces substantially perpendicular to the first cutting blade and thereafter substantially perpendicular to said longitudinal axis so as to split the wood or similar material in two directions, the handle shaft further having a top tang and a bottom tang that extend away from the head nominally in a plane defined by the longitudinal axis of the handle shaft and the second cutting edge, the top tang and the bottom tang being spaced apart from one another in said plane;

a third cutting blade disposed at an end of the cutting head opposite the end that includes the first cutting blade and being oriented substantially perpendicular to the first cutting blade, so that the tool may readily be rotated about the longitudinal axis so as to more readily exert shear forces to said longitudinal axis; and an elongate handle extension, the handle extension having an attachment end, a grip end, a top portion and a bottom portion, a top groove formed in the top portion of the handle extension so as to extend longitudinally from the attachment end toward the grip end of the handle extension for receiving the top tang, and a bottom groove formed in the bottom portion of the handle extension so as to extend longitudinally from the attachment end toward the grip end of the handle extension for receiving the bottom tang, the spacing between the top groove and the bottom groove being such that the attachment end of the handle extension may be inserted longitudinally into the handle shaft.

8. The tool of claim 7, wherein the tangs and grooves have respective substantially laterally symmetric, contoured upper and lower mating surfaces.

9. A tool for splitting wood or similar material, comprising:

a cutting head that includes a first cutting blade;

a handle shaft having a longitudinal axis that is substantially perpendicular to the first cutting blade, the handle shaft being joined to the cutting head so as to extend away from the cutting head and define two side surfaces that converge to form a second cutting blade on the same side of the handle shaft as the first cutting blade, the second cutting blade having an arcuate cutting edge, wherein the cutting edge of the second cutting blade becomes closer to the longitudinal axis with increasing distance from the cutting head, the second cutting blade being perpendicular to the first cutting blade so that the combined action thereof, when applied to the wood or similar material, first exerts shear forces substantially perpendicular to the first cutting blade and thereafter substantially perpendicular to said longitudinal axis so as to split the wood or similar material in two directions, wherein the cutting edge of the second cutting blade becomes closer to the cutting head with increasing distance from the handle shaft, the handle shaft further having a top tang and a bottom tang that extend away from the head nominally in a plane defined by the longitudinal axis of the handle shaft and the second cutting edge, the top tang and the bottom tang being spaced apart from one another in said plane;

a third cutting blade disposed at an end of the cutting head opposite the end that includes the first cutting blade and being oriented substantially perpendicular to the first cutting blade, so that the tool may readily be rotated about the longitudinal axis so as to more readily exert shear forces to said longitudinal axis, wherein the second cutting blade is disposed between the first cutting blade and the second cutting blade;

an elongate handle extension, the handle extension having an attachment end, a grip end, a top portion and a bottom portion, a top groove formed in the top portion of the handle extension so as to extend longitudinally from the attachment end toward the grip end of the handle extension for receiving the top tang, and a bottom groove formed in the bottom portion of the handle extension so as to extend longitudinally from the attachment end toward the grip end of the handle extension for receiving the bottom tang, the spacing between the top groove and the bottom groove being such that the attachment end of the handle extension may be inserted longitudinally into the handle shaft.

10. The tool of claim 9, wherein the tangs and grooves have respective substantially laterally symmetric, contoured upper and lower mating surfaces.

11. A tool for splitting wood or similar material, comprising:

a cutting head that includes a first cutting blade;

a handle shaft having a longitudinal axis that is substantially perpendicular to the first cutting blade, the handle shaft being joined to the cutting head so as to extend away from the cutting head and define a substantially flat surface and two side surfaces that extend from the substantially flat surface to converge to form a second cutting blade on the same side of the handle shaft as the first cutting blade and on the opposite side thereof as the substantially flat surface, the second cutting blade having an arcuate cutting edge, wherein the cutting edge of the second cutting blade becomes closer to the longitudinal axis with increasing distance from the cutting head, the second cutting blade being perpendicular to the first cutting blade so that the combined action thereof, when applied to the wood or similar material, first exerts shear forces substantially perpendicular to the first cutting blade and thereafter substantially perpendicular to said longitudinal axis so as to split the wood or similar material in two directions, wherein the cutting edge of the second cutting blade becomes closer to the cutting head with increasing distance from the handle shaft, the handle shaft further having a top tang and a bottom tang that extend away from the head nominally in a plane defined by the longitudinal axis of the handle shaft and the second cutting edge, the top tang and the bottom tang being spaced apart from one another in said plane;

a third cutting blade disposed at an end of the cutting head opposite the end that includes the first cutting blade and being oriented substantially perpendicular to the first cutting blade, so that the tool may readily be rotated about the longitudinal axis so as to more readily exert shear forces to said longitudinal axis; and an elongate handle extension, the handle extension having an attachment end, a grip end, a top portion and a bottom portion, a top groove formed in the top portion of the handle extension so as to extend longitudinally from the attachment end toward the grip end of the handle extension for receiving the top tang, and a bottom groove formed in the bottom portion of the handle extension so as to extend longitudinally from the attachment end toward the grip end of the handle extension for receiving the bottom tang, the spacing between the top groove and the bottom groove being such that the attachment end of the handle extension may be inserted longitudinally into the handle shaft.

12. The tool of claim 11, wherein the tangs and grooves have respective substantially laterally symmetric, contoured upper and lower mating surfaces.

13. A tool for splitting wood or similar material, comprising:

a cutting head that includes a first cutting blade;

a handle shaft having a longitudinal axis that is substantially perpendicular to the first cutting blade, the handle shaft being joined to the cutting head so as to extend away from the cutting head and define two side surfaces that converge to form a second cutting blade on the same side of the handle shaft as the first cutting blade, the second cutting blade having an arcuate cutting edge, wherein the cutting edge of the second cutting blade becomes closer to the longitudinal axis with increasing distance from the cutting head, the second cutting blade being perpendicular to the first cutting blade so that the combined action thereof, when applied to the wood or similar material, first exerts shear forces substantially perpendicular to the first cutting blade and thereafter substantially perpendicular to said longitudinal axis so as to split the wood or similar material in two directions, wherein the cutting edge of the second cutting blade becomes closer to the cutting head with increasing distance from the handle shaft the handle shaft further having a top tang and a bottom tang that extend away from the head nominally in a plane defined by the longitudinal axis of the handle shaft and the second cutting edge, the top tang and the bottom tang being spaced apart from one another in said plane;

a third cutting blade disposed at an end of the cutting head opposite the end that includes the first cutting blade and being oriented substantially perpendicular to the first cutting blade, so that the tool may readily be rotated about the longitudinal axis so as to more readily exert shear forces to said longitudinal axis, wherein the cutting head and the handle are one unitary element;

an elongate handle extension, the handle extension having an attachment end, a grip end, a top portion and a bottom portion, a top groove formed in the top portion of the handle extension so as to extend longitudinally from the attachment end toward the grip end of the handle extension for receiving the top tang, and a bottom groove formed in the bottom portion of the handle extension so as to extend longitudinally from the attachment end toward the grip end of the handle extension for receiving the bottom tang, the spacing between the top groove and the bottom groove being such that the attachment end of the handle extension may be inserted longitudinally into the handle shaft.

14. The tool of claim 13, wherein the tangs and grooves have respective substantially laterally symmetric, contoured upper and lower mating surfaces.

15. A tool for splitting wood or similar material, comprising:

a cutting head that includes a first cutting blade;

a handle shaft having a longitudinal axis that is substantially perpendicular to the first cutting blade, the handle shaft being joined to the cutting head so as to extend away from the cutting head and define two side surfaces that converge to form a second cutting blade on the same side of the handle shaft as the first cutting blade, the second cutting blade having an arcuate cutting edge, wherein the cutting edge of the second cutting blade becomes closer to the longitudinal axis with increasing distance from the cutting head, the second cutting blade being perpendicular to the first cutting blade so that the combined action thereof, when applied to the wood or similar material, first exerts shear forces substantially perpendicular to the first cutting blade and thereafter substantially perpendicular to said longitudinal axis so as to split the wood or similar material in two directions, wherein the cutting edge of the second cutting blade becomes closer to the cutting head with increasing distance from the handle shaft, the handle shaft further having a top tang and a bottom tang that extend away from the head nominally in a plane defined by the longitudinal axis of the handle shaft and the second cutting edge, the top tang and the bottom tang being spaced apart from one another in said plane;

a third cutting blade disposed at an end of the cutting head opposite the end that includes the first cutting blade and being oriented substantially perpendicular to the first cutting blade, so that the tool may readily be rotated about the longitudinal axis so as to more readily exert shear forces to said longitudinal axis, wherein the cutting head and the handle shaft are made of metal;

an elongate handle extension, the handle extension having an attachment end, a grip end, a top portion and a bottom portion, a top groove formed in the top portion of the handle extension so as to extend longitudinally from the attachment end toward the grip end of the handle extension for receiving the top tang, and a bottom groove formed in the bottom portion of the handle extension so as to extend longitudinally from the attachment end toward the grip end of the handle extension for receiving the bottom tang, the spacing between the top groove and the bottom groove being such that the attachment end of the handle extension may be inserted longitudinally into the handle shaft.

16. The tool of claim 15, wherein the tangs and grooves have respective substantially laterally symmetric, contoured upper and lower mating surfaces.

* * * * *